United States Patent [19]

Genequand et al.

[11] 4,075,535

[45] Feb. 21, 1978

[54] FLAT CATHODIC TUBE DISPLAY

[75] Inventors: Pierre Genequand, Geneva; Didier Joyeux, Petit-Lancy, both of Switzerland

[73] Assignee: Battelle Memorial Institute, Switzerland

[21] Appl. No.: 676,492

[22] Filed: Apr. 13, 1976

[30] Foreign Application Priority Data

Apr. 15, 1975 Switzerland ..... 4764/75
Apr. 15, 1975 Switzerland ..... 4766/75

[51] Int. Cl.[2] ..... H01J 29/50; H01J 31/10

[52] U.S. Cl. ..... 313/422; 313/366; 313/220

[58] Field of Search ..... 313/422

[56] References Cited

FOREIGN PATENT DOCUMENTS 556,605 11/1974 Switzerland ..... 313/422

*Primary Examiner*—Robert Segal
*Attorney, Agent, or Firm*—Robert E. Burns; Emmanuel J. Lobato; Bruce L. Adams

[57] ABSTRACT

A video cathode tube having a matrix of low emission threshold field effect emitters oriented to emit toward a luminescent layer. A first system of mutually insulated conductive paths is arranged along rows of emitters with the emitters in any row electrically connected to a corresponding conductive path of the first system. A second system of mutually insulated conductive paths is disposed in contact with the luminescent layer and extends in front of columns of the emitters. A first bank of contacts individually connected to respective conductive paths of the first system are sequentially energized to a first potential, and a second bank of contacts individually connected to respective conductive paths of the second system are sequentially energized to a second potential. A control grid connectable to a voltage source is interposed between the matrix of emitters and the second system of conductive paths. By modulating the potentials of the contacts with electrical signals representing an image when the grid is properly biased, luminous points on the luminescent layer will be sequentially developed opposite successive emitters to display on the luminescent layer an image represented by the electrical signals.

14 Claims, 16 Drawing Figures

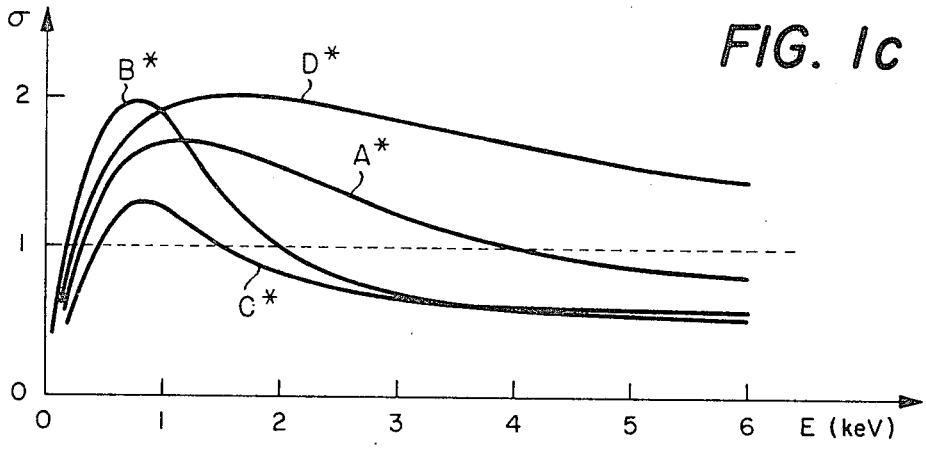
FIG. 1c
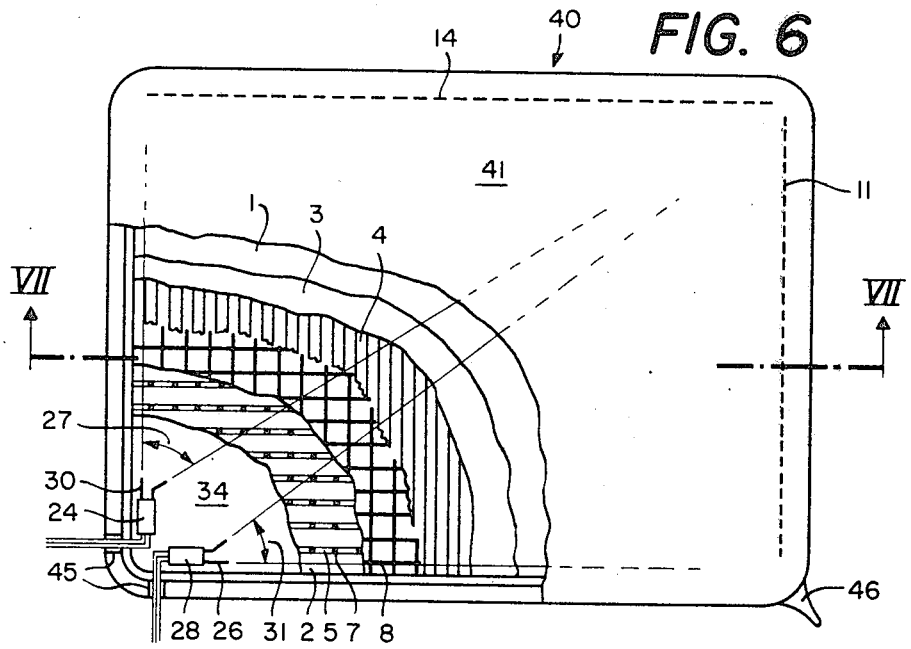
FIG. 6
FIG. 7
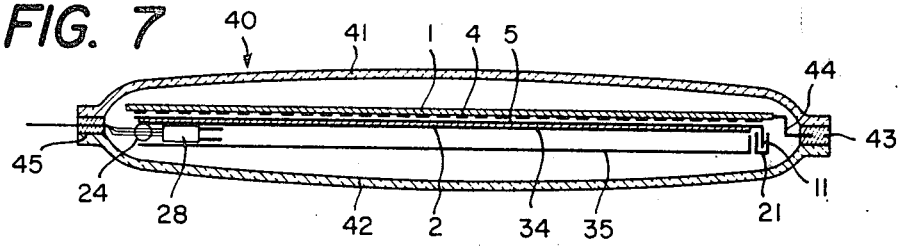

FLAT CATHODIC TUBE DISPLAY

In the field of videoscope display, the need is evident, at the present time, for a solution which is intermediate between the traditional cathode tube, which is heavy and cumbersome, and the electroluminescent display panel of the "flat" type, the appearance of which on the market remains problematic for the time being, both because of questions of performance (luminous efficiency) and reasons of manufacturing costs.

Devices are already known which fall within the perspective of such an intermediate solution, such as, for instance, the video-cathode tube described in Swiss Pat. No. 556,605 which is in the form of a parallelepiped of small thickness, the principle of which is based on separating the electron distribution function from the phosphor excitation function. In such a tube, as a matter of fact, the electron distribution function is assured by the use of two separate electron guns arranged behind the screen and parallel to it, so as independently to sweep two rows of contacts located along two perpendicular edges of the screen. One of these rows of contacts is connected to a first system of conductive strips which are parallel to each other and cover the layer of phosphor while the other row is connected to a second system of parallel strips which are provided with field-effect emission points directed towards the phosphor layer, and constitute a matrix which intersects the said first system. The contacts of these two rows are covered with metals having secondary-emission properties such that, under the effect of the sweeping by the electron beams, the strips covering the phosphor are charged sequentially to a first positive potential while the strips provided with points are charged sequentially to a second potential which is negative with respect to the first potential, so that at the intersection of the strips swept the difference in potential rises up to the emission of electrons by the point located at that place. The exciting of the phosphor is then assured by these emitted electrons which are accelerated by this potential difference until they bombard the phosphor field located at the point of intersection.

However, the proper operation of such a video-cathode tube raises a certain number of problems, two of the main problems relating to the potential difference which is established at the intersection of the strips swept.

The first of these problems resides in the fact that it is this potential difference alone which must simultaneously assure the electron extraction and acceleration operations, which makes any independent control of the field effect emission and phosphor excitation processes impossible. Now it is known, on the one hand, that the process of excitation of the phosphor requires the use of high accelerating voltages of the order of several kilovolts (the brightness E produced by the excited phosphor varies, as a matter of fact, with the energy of the incident electrons, and therefore with the voltage V necessary to accelerate these electrons, in accordance with the equation $E = n_1(V - Vo)^n 2$ in which $Vo$ represents the loss of energy of the electrons in the conductive layer covering the phosphor, $n_1$ is a proportionality factor and $n_2$ a coefficient of a value of between 1 and 2). It will be seen, on the other hand, that it is highly desirable, for various reasons which will be studied subsequently, to use field-effect emitter points which emit under relatively low voltages, of the order of a few hundred volts. These voltage conditions, which are difficult to reconcile due to the interdependence of the field-effect-emission and phosphor-excitation processes, constitute a particularly disturbing drawback on the part of the existing video-cathode tubes.

The second of these problems relating to the potential difference established at the intersection of the strips swept, resides in the difficulty of obtaining a potential difference which is sufficiently high, stable, and reproducible in time. The obtaining of such a potential difference requires, on the one hand, that the contacts of the first system of strips covering the phosphor layer have a yield of secondary electrons which is definitely higher than 1, and which is stable with time within the range of energy used, so as to be able to bring said strips to this highly positive potential, and, on the other hand, that the contacts of the second system of strips provided with points have a yield of secondary electrons which is definitely less than 1 (or, as we will see subsequently, that a suitable device is associated with said contacts) so as to be able to bring the said strips to a slightly positive potential. Now it has been observed in the present-day tubes that the secondary emission phenomena vary greatly during the course of time, due in particular to the progressive appearance on the contacts of surface pollutions due to the action of the primary electrons emitted under a medium vacuum ($10^{-6}$ to $10^{-7}$ mm Hg). It is thus noted that the yield of secondary electrons of the contacts of the first system decreases gradually below 1 whatever the nature of the material constituting the said contacts, while the yield of secondary electrons of the contacts of the second system gradually approaches 1 during the course of time, so that it rapdily becomes impossible to obtain a sufficient potential difference at the point of intersection of the swept strips to produce an electron emission capable of exciting the phosphor.

The object of the present invention is specifically to overcome these drawbacks.

For this purpose, the object of the present invention is a video-cathode tube which is intended for the restitution in visible form of the electric signals representing an image, comprising an enclosure which is void of air and is bounded by a wall of which a portion constitutes a transparent window, this enclosure containing:

a layer of at least one luminescent substance (3; 103) borne by a transparent plate (1; 101), this layer having a size substantially equal to that of the said window and being visible through it;

a matrix of field-effect emitters of low emission threshold (7; 107) distributed in rows and columns and oriented in such a manner as to emit towards the said luminescent layer;

a first layer of conductive paths (5; 105) insulated from each other and disposed along rows of emitters, each of the emitters of any one line being connected electrically to the corresponding path of said first system;

a second system on conductive paths (4; 106) insulated from each other and from the paths of the said first system and extending along columns of emitters;

a first group of means (11, 28; 111, 128) capable of sequentially bringing the paths of the said first system to a first potential;

a second group of means (14, 24; 114, 124) capable of sequentially bringing the paths of the said second system to a second potential, and an electrode (8; 104) connected to a source of potential ($V_8$; $V_{104}$) and is arranged substantially parallel to the said luminescent layer and having substantially the same length as it, the arrangement of said electrode relative to said second system of conductive paths on the one hand, and the selection of the potential of the said source and of the said second potential with respect to the said first potential, on the other hand, being such as to bring about, simultaneously at the intersection of the paths brought to the said first and second potentials respectively, in the immediate vicinity of the end of the emitter located at said intersection, a small potential drop which is sufficient to cause the emission by field effect of electrons from said emitter and, in the vicinity of the luminescent layer portion located at this intesection, a high potential drop capable of imparting to the emitted electrons sufficient energy to excite said luminescent layer portion, the said first or second group of means being modulated by said signals in such a manner that said luminescent layer portion is illuminated as a function of said signals, the group of luminous points thus sequentially obtained constituting the said image.

Another object of the present invention is a video-cathode tube which is intended for the restitution in visible form of electric signals representing an image, which comprises an enclosure which is void of air, bounded by a wall a portion of which constitutes a transparent window, said enclosure containing a layer of at least one luminescent substance (3; 103) borne by a transparent plate (1; 101), this layer having a size substantially equal to that of said window and being visible through it;

a matrix of field-effect emitters with low emission threshold (7; 107) distributed in rows and columns, oriented in such a manner as to emit towards the said luminescent layer, a first system of conductive paths (5; 105), insulated from each other and arranged along rows of emitters, each of the emitters of any row being connected electrically to the corresponding path of the said first system;

a second system of conductive paths (4; 106), insulated from each other as well as from the paths of the said first system and extending along columns of emitters;

a first group of means (11, 28; 111, 128) capable of sequentially bringing the paths of the said first system to a first potential, a second group of means capable of sequentially bringing the paths of said second system to a second potential, said second group of means comprising, in combination, a bank of contacts (14; 114) and formed, at least in part, of a material having properties of secondary electron emission and connected individually to the paths of said second system, and an electron gun (24; 124) capable of emitting an electron beam (25; 125) which can sequentially sweep each of said contacts, the instantaneous difference between said second and first potentials constituting the factor which determines the intensity of excitation of the said luminescent substance, characterized by the fact that the said gun (24; 124) and the said bank (14; 114) are arranged in such a manner with respect to each other that the said beam (25; 125) arrives on the receptive surfaces of said contacts with an oblique incidence such that the efficiency of secondary electron emission of these contacts is greater than 1.

The accompanying drawing shows, diagrammatically, by way of example, two embodiments, as well as variants, of the video-cathode tube which forms the object of the present invention.

FIGS. 1*a*, 1*b*, and 1*c* are diagrams or diagrammatic views explaining the principles employed in the device of the invention.

FIG. 6 is a front view, from the outside, of the entire device.

FIG. 7 is a section along the line VII—VII of FIG. 6.

Before describing the device proper, it is advisable, first of all, to examine more thoroughly the problems raised by field effect emission phenomena as well as by secondary electron emission phenomena, which form the basis of the present invention. This examination will enable us then to describe the principles of solution employed in order to solve these problems.

Let us first of all examine the field effect emission phenomena, pointing out in particular the different parmaeters which can affect these phenomena.

The field effect emission properties exhibited by certain point-shaped conductive materials — that is to say the ability which these points have to emit electrons when they are placed in relatively intense electric fields — are in fact a function of a number of parameters, among which mention may be made of the intrinsic characteristics of the material constituting the point (work function, electrical conductivity, etc.), the geometry of this point (radius of the end, shape of the point, etc.), and its surface state.

The variation of the current I emitted by a point as a function of the potential difference $\Delta V$ which is caused to prevail in the vicinity of such point is given by a well known theoretical law, the so-called Fowler-Nordheim Exponential Law, which in the case of a point of paraboloid shape, for instance, is in the following form:

$$I = A_1 r^2 \beta^2 \Delta V)^2 \exp\left[-A_2/\beta\Delta V\right]$$

in which $A_1$ and $A_2$ are constants, $r$ is the radius of the end of the point, and $\beta$ is a coefficient, known as the amplification factor, which is a function of the radius $r$ of the point and of the distance $d$ from said point to the oscillator anode serving to bring about $\Delta V$, in accordance with the equation $$\beta = \frac{2}{r \operatorname{Log}(4\, d/r)}$$

Figure 1A:
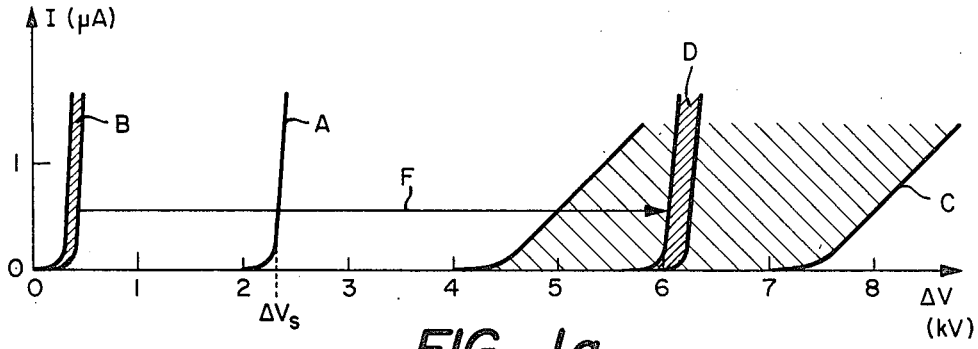

This theoretical Fowler-Nordheim Law is represented in the I−Δ $V$ diagram of FIG. 1*a* (I being expressed in microamperes and Δ$V$ in kilovolts) by curve A, the so-called current-voltage characteristic of the emitter. This characteristic A, which has been drawn for a particular value of the point radius, shows a first, practically horizontal branch corresponding to practically zero emission and a second strongly ascending branch which corresponds to very intense emission as soon as the potential difference applied exceeds a threshold value of Δ $Vs$.

By varying the value $r$ of the point radius one would thus obtain an entire family of characteristics in the I−Δ $V$ curve, each of these characteristics shifting towards higher voltage with decrease of its slope as the radius $r$ increases.

We will define as "low-voltage emitters" emitters which are capable of emitting at low critical Δ $Vs$ values (of the order of 500 V) and having steep-slope characteristics, which corresponds to very pointed emitters (point radius $r$ between 100 and 1000 Angstroms). Similarly, we will designate as "high-voltage emitters" emitters having high critical Δ $Vs$ values (of the order of 5 kilovolts) and characteristics of lesser slope, which corresponds to emitters having more rounded points (point radius $r$ between 1000 and 10,000 Angstroms).

However, a certain number of factors relating to the manufacturing techniques used (inevitable difference in the state of the surface from one point to another, difficulty in controlling the radius of the points during manufacture), and to operating conditions (change of the surface condition with time during emission) bring about an inevitable dispersion of the characteristics of these points. For this reason, the shape of the actual characteristics differs substantially from that of the theoretical characteristics given by the Fowler-Nordheim Law. By way of example, FIG. 1*a* shows two of these actual characteristics, namely a characteristic B relating to a low-voltage emitter and a characteristic C relating to a high-voltage emitter (the width of the hatched zones representing the dispersion of these characteristics). It can be noted from this FIG. 1*a* that characteristic B, which relates to the low-voltage emitter, has definitely a steeper slope and a considerably smaller absolute dispersion than characteristic C, which refers to the high-voltage emitter.

Let us examine more closely the factors which are the cause for the dispersion of these characteristics. One knows how to produce in theory practically perfect surface states (cleaning of the emitters by high-temperature flash, for example) and prevent these surface conditions from changing during the course of time (operation of the emitters under ultra-vacuum, for instance). The conditions to be satisfied in order to arrive at this result are, however, incompatible with mass production requirements and operation in a medium vacuum. Thus it is found that the residual atmosphere present in any video-cathode tube (vacuum of about $10^{-7}$ mm Hg) gives rise to a certain amount of pollution which gradually alters the surface condition of the emitters. These pollutions which result in the progressive appearance on the surface of the emitters of monolayers of foreign atoms result both from mechanisms of direct interaction between the residual atmosphere and the emitters and from mechanisms of the "cathode-sputtering" type due to the ionization of the residual atmosphere by the electrons emitted.

The surface condition of the emitters may furthermore be disturbed by the presence in the vicinity of their points of relatively intense electrical fields, which may bring about a change in their surface crystalline structure (for example migration of atoms).

In addition to this progressive alteration of the condition of the surface, there is another factor which is also responsible for the lack of reproducibility of the emitters (and therefore for the dispersion observed in the characteristics of these emitters), which factor originates in the difficulty experienced during manufacture in controlling with high precision the radius of the end of these emitters, particuariy when it is a question of manufacturing emitters having relatively rounded points. While one knows how to manufacture very pointed emitters with relatively precise radii and reproducible cone angles (radii guaranteed below a certain value), on the other hand greater difficulties are encountered in manufacturing rounded emitters with similar precision. As a matter of fact, in order to manufacture rounded emitters one generally starts from pointed emitters which are then progressively rounded off by various techniques; it is precisely these techniques which one has the greatest trouble in mastering perfectly, which explains in part why the high voltage emitters show a definitely greater dispersion than the low voltage emitters.

For reasons which will be explained subsequently, it will be seen that it is strongly desirable to be able to use emitters which have characteristics of steep slope and low dispersion, that is to say low-voltage emitters. However, as the use of such emitters is difficult to make compatible with the "high-voltage" requirement necessary for the exciting of the phosphor, it is necessary to find some artifice which makes it possible to solve this apparent incompatibility. This is precisely what is proposed with the device in accordance with the invention.

The principle of solution adopted in such a device consists, as a matter of fact, in using low voltage emitters and interposing between said emitters and the anode part, an intermediate electrode which has been brought to a suitable potential, in order to assure — as will now be explained in detail — a translation of the low voltage characteristics of these emitters towards high voltages.

Let us assume that an emitter "*c*" has been brought to a first potential $V_c$ and an anode part "*a*" arranged opposite this emitter "*c*" has been brought to a second potential $V_a$ which is strongly positive with respect to the potential $V_c$. The potential drop $\Delta V_1$ prevailing in the immediate vicinity of the emitter "*c*" is equal to:

$$\Delta V_1 = V_a - V_c$$

Figure 1B:
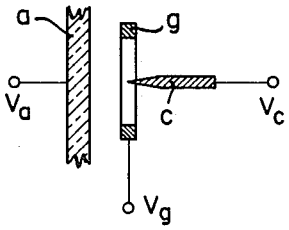

Let us now place between the anode part "*a*" and the emitter "*c*" an intermediate electrode "*g*", brought to a third potential $V_g$ (see diagrammatic showing of FIG. 1*b*). As the pointed emitters have the property of concentrating the voltage drop in the immediate vicinity of their point, the diagram of the electrical fields in the space located between the point and the anode part is, for all practical purposes, not changed by the presence of this point, and one can thus, in first approximation, establish that the drop in voltage $\Delta V_2$ prevailing in the vicinity of the point is equal to the difference between an average of the voltages of the surfaces located in the vicinity of the point (intermediate electrode at potential $V_g$ and anode part at potential $V_a$) and the voltage $V_c$ applied to said point, namely:

$$\Delta V_2 = \frac{V_a + kV_g}{1 + k} - V_c$$

in which $k$ designates a coefficient which depends on the configuration of the different surfaces.

Let us now suppose that the emitter "c" is a low-voltage emitter having a real characteristic I ($\Delta V_{em}$) (that is to say, a characteristic representing the variation of the current I carried by the electrons emitted as a function of the voltage drop $\Delta V_{em}$ prevailing in the immediate vicinity of the emitter) which has a shape identical to that of curve B, shown in the diagram of FIG. 1. In order to obtain a given emission current I from this emitter "c", it is thus necessary that a voltage drop $\Delta V_{em}$, indicated by the curve B, prevail in the immediate vicinity of this emitter and that, therefore, the values $V_a$ and $V_c$ (it will be assumed that $V_g$ remains constant) be controlled in such a manner that one either has, in the absence of intermediate electrode "g" $\Delta V_1 = \Delta V_{em}$ or, in the presence of said intermediate electrode "g", $\Delta V_2 = \Delta V_{em}$.

Let us assume first of all that one keeps $V_c$ constant and acts only on $V_a$. In the absence of intermediate electrode "g", it is thus necessary, in order to obtain an emission current I, to select $V_a$ equal to $V_{a1}$ such that:

$$V_{a1} = \Delta V + V_c$$

In the presence of intermediate electrode "g", it is necessary, on the other hand, in order to obtain the same current I, to select $V_a$ equal to $V_{a2}$ in such a manner that $$V_{a2} = (1 + k)\,\Delta V_{em} - kV_g + V_c(1 + k)$$

In the absence of intermediate electrode "g", there therefore corresponds for the emitter "c" an apparent characteristic I ($V_{a1} - V_c$) which is identical to the real characteristic I ($\Delta V_{em}$). (The drop in voltage $\Delta V_{em}$ prevailing in the immediate vicinity of the emitter is, as a matter of fact, a variable which is internal to the system and which it is impossible to "see" from the outside, the only variations which it is possible to note from the outside being the variations of the current I as a function of the potential difference ($V_a - V_c$) applied between emitters and anode part). To these variations there correspond in the I − Δ V diagram apparent characteristcs I ($V_a - V_c$) which are known as equivalent characteristics. In order to determine the manner in which these equivalent characteristics I ($V_a - V_c$) result from the real characteristics I ($\Delta V_{em}$), it is necessary to establish the relationship existing between the internal voltage drop $\Delta V_{em}$ and this applied outer potential difference ($V_a - V_c$)).

In the presence of the intermediate electrode "g", there corresponds to the emitter "c" an apparent characteristic I ($V_{a2} - V_c$) which, as shown by the relationships established above, follows from the real characteristic I ($\Delta V_{em}$) by a translation in voltage equal to k ($\Delta V_{em} + V_c - V_g$). Moreover, the slope $\partial I/\partial V_a$ of this apparent characteristic, which is given by the relationship $$\partial I/\partial V_a = (\partial I/\partial \Delta V_{em})\,(\partial \Delta V_{em}/\partial V_a)$$

is divided, with respect to that of the real characteristic, by a factor $(1 + k)$.

Thus the interposing of an intermediate electrode between the emitter and the anode part has primarily the effect of resulting in the translation of the real characteristic I ($\Delta V_{em}$) of this emitter by a voltage equal to $k\,(\Delta V_{em} + V_{c-Vg})$. By a suitable selection of the coefficient k and of the voltages $V_c$ and $V_g$ one can thus translate the characteristic of a low-voltage emitter (1 microampere at 300 volts) into a high voltage characteristic (1 microampere at 6 kilovolts). This is what is shown diagrammatically in FIG. 1*a*, in which (by the selection of a configuration which gives a coefficient $k$ close to 1 and by the application of a voltage $V_g$ equal to −5.4 kilovolts and a voltage $V_c$ equal to +50 volts), curve B is translated into curve D (translation indicated diagrammatically by the arrow F in the drawing). It can be noted from this FIG. 1*a* that the translated curve D has a slope which is definitely steeper and a dispersion which is definitely less than those shown by the characteristic C relating to a high voltage emitter.

Let us now assume that one mantains $V_a$ constant and acts only on $V_c$ (opposite hypothesis to the preceding one).

In the absence of the intermediate electrode "g" it is therefore necessary, in order to obtain an emission current I, to select $V_c$ equal to $V_{c1}$, such that $$V_{c1} = V_a - \Delta V_{em}.$$

To this situation there corresponds, for the emitter "c", an apparent characteristic I ($V_a - V_{c1}$) which is identical to the real characteristic I ($\Delta V_{em}$).

In the presence of the intermediate electrode "g", it is necessary, on the other hand, in order to obtain the same current I, to select $V_c$ equal to $V_{c2}$ such that:

$$V_{c2} = \frac{V_a + kV_g}{1 + k} - \Delta V_{em}$$

To this situation there corresponds, for the emitter "c", an apparent characteristic I ($V_a - V_{c2}$) which, as shown by the above relationships, is obtained from the real characteristic I ($\Delta V_{em}$) by a translation in voltage equal to $[k/(1+k)](V_g - V_a)$. Therefore, by a judicious selection of the coefficient k and of the voltages $V_g$ and $V_a$ one can translate the characteristic of a low-voltage emitter to the region of high voltages. Furthermore, it can be noted that the slope $\partial I/\partial V_c$ of this apparent characeristic, which is given by the equation $$\partial I/\partial V_c = (\partial I/\partial V_{em})\,(\partial V_{em}/\partial V_c),$$

remains unchanged.

It has furthermore been assumed in this second case ($V_a$ constant and $V_c$ variable) that the voltage $V_g$ remained constant. Let us now assume that this voltage undergoes a change and that it passes, for instance, from the value $V_g$ to the value $V'_g$. This change in the voltage, applied to the intermediate electrode "g", has the effect — as shown by the above equations — of bringing about an additional translation of the apparent characteristic of the emitter by an amount $[k/(1 + k)]\,(V'_g - V_g)$.

Let us now examine the secondary electron emission phenomena, pointing out in particular the different parameters which may have an influence on these phenomena. The secondary electron emission properties which certain materials exhibit — that is to say the ability which these materials have to emit so-called "secondary" electrons when they are subjected to a bombardment with so-called "primary" electrons — and in particular the secondary emission yield of these materials — that is to say the ratio between the secondary electrons emitted and the primary electrons absorbed — depend, as a matter of fact, on a number of parameters, among which mention may be made of the intrinsic characteristics of the material (work function, electrical conductivity, etc.), the surface condition of said material, the energy of the incident primary electrons, and the angle of incidence of these electrons with respect to the bombarded surface. FIG. 1*c* illustrates the variations of this secondary emission yield $\sigma$ as a function of the energy of the incident primary electrons E (expressed in kiloelectronvolts) for different values of these parameters.

The curves A* and B* shown in this FIG. 1*c* illustrate the behavior of a gold material bombarded with normal incidence as a function of the condition of its surface, the curve A* corresponding to a clean gold surface and the curve B* corresponding to a polluted gold surface (the pollution being due, we may recall, to the action of the primary electrons under a medium vacuum). It will be noted that while the clean gold surface has a yield $\sigma$ which is greater than 1, this yield $\sigma$ is, on the other hand, rapidly lowered below 1 within the energy range from 3 to 6 kV of the primary electrons by the progressive appearance of the surface pollutions. The use of such a material, despite its high initial yield, is therefore not desirable in the application contemplated, due to the instability of this yield as a function of the pollution. As for the curve C*, it concerns the behavior of a stainless steel material bombarded with normal incidence. This curve C* illustrates the great stability of the yield $\sigma$ shown by this material as a function of the pollution. As a matter of fact, it can be noted that, starting from a clean stainless steel surface, the yield $\sigma$ of this surface is practically unaffected by the progressive appearance of the pollution. The solution for the obtaining of a secondary emission yield which is definitely greater than 1 and is stable with the passage of time therefore consists in using a material which is insensitive to pollution, whose secondary emission yield may moreover be close to or even less than 1, and bombarding it with practically grazing incidence. It is precisely this solution which is utilized in the device which will now be described. It will be noted, however, that the yield $\sigma$ remains definitely less than 1, within the desired energy range, for normal incidence.

It is furthermore known that the bombardment of any surface under oblique incidence has the effect of increasing its secondary emission yield $\sigma$. This increase in the yield $\sigma$ is illustrated quantitatively by an approximate empirical equation, which is valid within the energy range mentioned and which gives the variation of this yield as a function of the angle of incidence $\sigma$ (angle of incidence of the beam with respect to the normal):

$$\sigma\text{oblique} = \sigma\text{normal}/\cos\sigma$$

in which $\sigma$ normal is the yield corresponding to normal incidence.

The curve D* shown in FIG. 1*c* illustrates the behavior of a stainless steel material similar to that of curve C* but bombarded with practically grazing incidence (angle $\sigma$ about 80°). It will be noted that the bombardment with grazing incidence results in a substantial increase in the yield $\sigma$, the latter becoming definitely greater than 1 and furthermore remaining relatively stable as a function of the progressive appearance of the surface pollutions.

The embodiment shown in FIGS. 2 to 7 comprises a first transparent support plate 1 which is arranged opposite a second support plate 2, which may be opaque. For reasons which will become evident further below, the support plate 1 will be referred as the "anode" plate and the support plate 2 will be called the "cathode" plate. The side of the anode plate 1 which faces the cathode plate 2 is covered with a layer 3 of an ordinary luminescent material (for instance a "phosphor"). Over this luminescent layer there is arranged a series of fine very thin conductive strips 4, referred to as anode strips, insulated electrically from each other and disposed parallel to each other (in the vertical direction in the example shown in FIG. 2). In the face of the cathode plate 2 which faces the anode plate 2 there is embedded a series of conductors 5, referred to as cathode conductors, which are insulated electrically from each other and disposed parallel to each other, in a direction perpendicular to the direction of the anode strips (and therefore in the horizontal direction in the example shown in FIG. 2).

Figure 5:
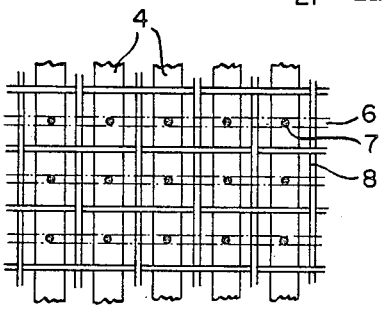
FIG. 5 is a partial sectional view along the line V—V of FIG. 3.

These cathode conductors 5 are formed of rigid metal bands 6 embedded at one of their edges in the face of the cathode plate 2 and provided over the entire length of their other edge with a plurality of points 7 arranged at uniform intervals apart so that each point is opposite an anode strip 4, the bands 6 provided with their point 7 thus having the shape of cones. These points 7 are made of a material of high field effect emission power and their characteristics (particularly the diameter of their ends) are so selected that the field emission can be produced for low extraction potential values (less than 1 kV). Therefore, employing the terminology used above, these are low-voltage points. Between the anode strips 4 and the cathode bands 5 there is a metal grid 8 located in a plane passing substantially through the end of each of the points 7 (FIGS. 3 and 4) and so arranged that the end of each of these points 7 is practically at the center of each of the meshes constituting the grid 8 (FIG. 5).

The anode strips have, for instance, a width of the order of 0.3 mm, a spacing of the order of 0.2 mm, and a thickness of the order of a micron. The cathode bands have a thickness of the order of 0.1 mm and a spacing of the order of 0.7 mm. On the other hand, their width is immaterial, for instance 4 mm. The points have a diameter at the base of the same order of thickness as the cathode band 5, a length of the order of 5 mm, and a diameter of their tip of 1000 Angstroms, while their pointed end is located at a distance of about 1 to 2 mm from the anode strips. Such a configuration gives a coefficient $k$ (see above) which is close to 1. As example, these points may be made of stainless steel covered with a thin layer of carbon.

The cathode combs 5 are connected to blades 10 which protrude from the "rear" face of the cathode plate 2, that is to say the face opposite the one which bears the cathode combs 5 and the assembly of these blades 10 constitutes a bank 11 of cathode "contacts" which are aligned along the vertical edge of this cathode plate 2, without touching it.

The anode strips 4 are, in their turn, connected to blades 12 which protrude also on the same face of the cathode plate 2 but on the horizontal side thereof. Each of these blades 12 is composed of a flat part 12*a* which is extended by a band 13 of slight thickness folded a number of times on itself in zigzag shape so as to form a series of dihedrals with identical angles succeeding each other alternately presenting their opening towards the top and bottom so that the edges of the said dihedrals which are open towards the bottom are located in a first plane which coincides with that of the flat portion 12*a* while the edges of the said dihedrals which are open towards the top are located in a second plane parallel to the first and located below the latter. For reasons which will be explained subsequently, the angles of these successive dihedrals are preferably between 10° and 20°. The band 13 can, for instance, be a stainless steel band of a width of about 0.3 mm and a thickness of about 0.03 mm. The height of the zigzags may be of the order of 1 mm to 1.5 mm and their total width may, for instance, be about 10 mm (for a screen of a diagonal of 700 mm).

The assembly of these zigzag bands 13 constitutes a bank 14 of anode "contacts" which are aligned with the extension of the upper edge of the cathode plate 2.

Figure 2:
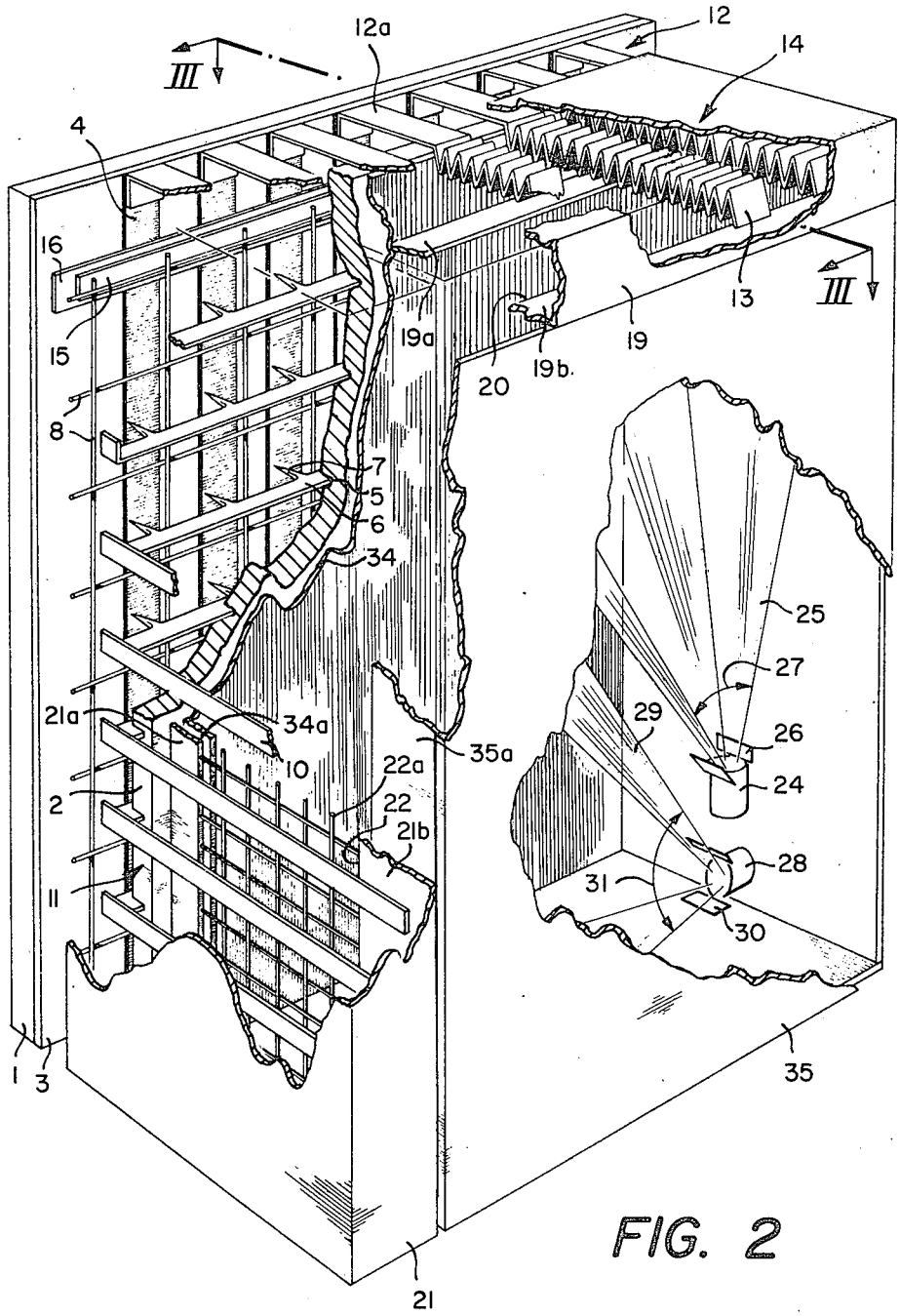
FIG. 2 is a perspective view, partially cut away, of the inside of a first embodiment.
Figure 3:
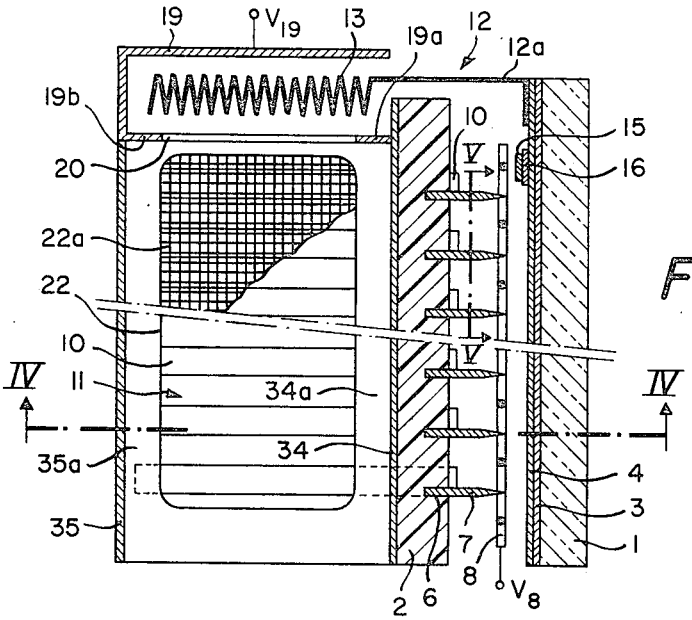
FIG. 3 is a sectional view along the line III—III of FIG. 2.
Figure 4:
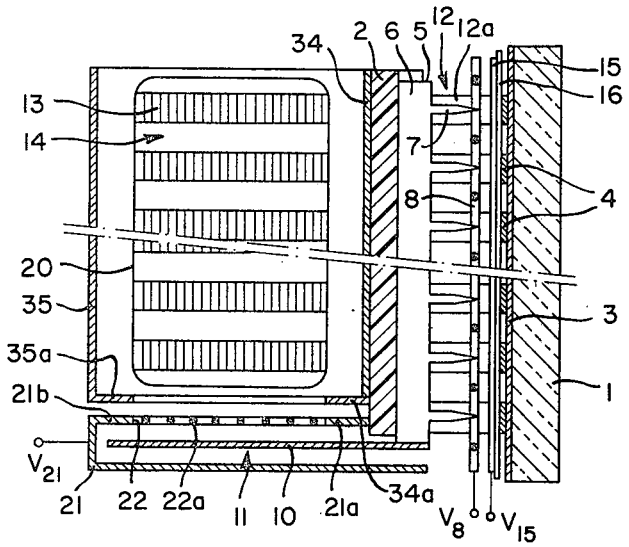
FIG. 4 is a sectional view along the line IV—IV of FIG. 3.

The anode plate 1 also bears an auxiliary conductive strip 15 which is disposed across the group of anode strips 4 (and therefore in horizontal direction in the case of the example shown in FIG. 2) and separated from the latter by a slightly conductive insulating layer 16 which has "electric leaks" with respect to the anode strips.

The bank of anode contacts 14 is surrounded by a conductive electrode of parellelepiped shape, in the lower face of which there is cut a rectangular window 20 which practically entirely reveals the group of zigzag bands 13. Similarly, the bank of cathode contacts 11 is surrounded by a conductive electrode 21 of parallelepiped shape, in the inner face of which there is also provided a rectangular window 22 which makes it possible to see practically the entire group of contact blades 10. Between the edges 21*a* and 21*b* of this opening 22 there is stretched a small-mesh grid 22*a* (visible in cross section in FIG. 4 and in part in FIG. 3). For reasons which will become evident further below, the electrode 19 will be referred to as the "collector" electrode and the electrode 21 as the "suppressor".

The collector electrode 19 is connected to a first external voltage source $V_{19}$ which is highly positive (of the order of a few kilovolts), capable of bringing it to a positive potential with respect to the potential of the zigzag contacts 13. The suppressor 21 is connected to a second external voltage source $V_{21}$ which is slightly positive (of about 100 volts). The grid 8 in its turn is connected to a third external voltage source $V_8$ which is strongly negative (of the order of a few kilovolts). By way of example, the voltage source $V_{19}$ can be 6 kilovolts, the voltage source $V_{21}$ 50 volts, and the voltage source $V_8$ - 5 kilovolts.

Behind the cathode plate 2, in the corner opposite both the cathode bank 11 and the anode bank 14 there are placed two electron guns 24 and 28. The gun 24, the so-called "anode" gun, is pointed perpendicularly to the anode bank 14 (that is to say pointed in the vertical direction in the example shown in FIG. 2). The anode gun 24 is equipped with focusing devices (not shown) making it possible to obtain an electron beam 25 of rectangular or flattened-elliptical cross section, whose length and width are substantially equal to the length and width respectively of each of the "zigzag" bands 13 constituting the anode bank 14, and with sweeping devices (of which only the deflector plates 26 are shown) causing said electron beam 25 to sweep said anode bank 14 through the window 20, which is represented by the arrow 27.

The gun 28, called the "cathode" gun, is pointed perpendicular to the cathode ramp 11 (that is to say, pointed in the horizontal direction in the case of the example shown in FIG. 2). This cathode gun 28 is equipped with focusing devices (not shown) which make it possible to obtain an electron beam 29 of also rectangular or flattened elliptical cross section, the length and width of which are substantially equal to the width of the window 22 and the width of the blades 10 constituting the cathode bank 11 respectively, and with sweeping devices (of which only the deflector plates 30 are shown), causing said electron beam 29 to sweep said cathode bank 11 through the window 22, which represents the arrow 31.

The space swept by the group of two beams, the cathode beam and the anode beam, is furthermore defined by two parallel conductive plates constituting electrical shieldings, namely a first shielding 34 disposed against the rear face of the cathode plate 2 and a second shielding 35 (visible only in part in FIG. 2) arranged behind the guns 24 and 28. These shieldings 34 and 35 extend respectively, on the side of the anode bank 14 (FIG. 3), until they come in contact with the edges 19*a* and 19*b* of the window 20 cut in the collector electode 19 so that they also are brought to the potential $V_{19}$ of said electrode 19 and, on the side of the cathode bank (FIG. 4), to the vicinity only of the suppressor 21, so that they are electrically insulated from this suppressor 21 which has been brought to the slightly positive potential 21. The ends of these shields 34 and 35 which are located in the vicinity of the suppressor 21 are provided with inner flanges 34*a* and 35*a* respectively arranged substantially opposite the edges 21*a* and 21*b* respectively of the window 22 cut in the suppressor 21.

The role of the shields 34 and 35 which have been brought to the high voltage potential $V_{19}$ is to prevent the possible appearance of external parasitic fields which could disturb the trajectory of the cathode beam 29 and the anode beam 25 before they arrive on the respective banks 11 and 14, while the presence of the flanges 34*a* and 35*a*, brought to the high voltage potential $V_{19}$, and of the grid 22*a*, brought to the low voltage potential $V_{21}$, is intended to limit the high-voltage/low-voltage gradient to the smallest volume possible and to prevent the field produced by the strongly positive shielding from exerting an extracting effect near the cathode bank 11.

The assembly which has just been described is enclosed in a hermetic, air-free enclosure at least one face of which is transparent and makes it possible to view the anode plate 1 and, through it, the layer of luminescent material with which it is covered on its inner face. This is shown diagrammatically in FIGS. 6 and 7, where one can note the enclosure 40 formed of two shells 41 and 42 assembled by welding to each of the faces of a flat annular ring 43. Since the front shell 41 must be transparent, it is advantageous to make both shells 41 and 42, as well as the ring 43, of glass; this facilitates the welding of the shells to the ring. The shells 41 and 42 can, for instance, be of heat-treated glass and the ring 43 of fritted glass.

Within the enclosure 40 there can also be noted the anode plate 1, the cathode plate 2, the grid 8, the system of anode strips 4, the system of cathode combs, the bank 11 of the cathode contacts and, in part, the bank 14 of the anode contacts (not visible in FIG. 7), as well as the anode gun 24 and cathode gun 28. Making the enclosure from two shells, welded on a ring, makes it possible to attach these different parts to the entire periphery of said ring 43, as well as to provide, in said ring 43, passages for the different electrical connections to the outside (mechanical assemblies and electric passages illustrated schematically in FIG. 7 and by the numbers 44 and 45 respectively).

The shieldings 34 and 35, consisting of metal plates, can, as a variant, be replaced by conductive layers which cover the rear face of the cathode plate 2 and the inner face of the rear shell 42, respectively. After welding the shells 41 and 42 onto the ring 43, the enclosure 40 is evacuated through the stem 46.

It has just been stated that the shells 41 and 42 could be made of heat-treated glass. As a matter of fact, it is no longer necessary to use lead glass (and therefore non-heat-treatable glass) as in the case of conventional tubes, since the operating voltages employed (6 to 8 kV instead of the customary 20 kV of the conventional tubes) eliminate practically any risk of the production of x-rays. This heat-treated glass has the advantage over lead glass that it is less expensive and is of higher mechanical strength, which permits a reduction of the thickness of the glass and therefore a decrease in the total weight.

The operation of the device which has just been described is as follows: the sweeping of the bank of anode contacts 14 by the beam 25 of the anode gun 24 has the effect of extracting secondary electrons from the zigzag bands 13 constituting the said bank 14, which secondary electrons are collected by the collector electrode 19 connected to the voltage source $V_{19}$ (capable, as we have stated, of bringing said electrode 19 to a positive potential with respect to the potential of the contacts 14). The angle of incidence and the energy of the beam 25 are such (the beam 25 actually striking the different individual faces of the zigzag bands with practically grazing incidence due to the special geometrical configuration of these zigzag bands) that the secondary electron yield of the zigzag bands 13 struck by this beam is definitely higher than 1, so that the anode strips 14 assume a positive charge under the effect of this high secondary emission, and, therefore, a positive potential. This potential may reach high positive values of the order of a few kilovolts.

The auxiliary strip 15 (FIG. 4) is connected to an external voltage source $V_{15}$ in such a manner as to impart to the anode strips 4, as long as the latter are not struck by the electron beam 25, a given potential which depends on the electrical leaks from the insulating layer 16.

The sweeping of the bank 11 of cathode contacts by the beam 29 of the cathode gun 28 also has the effect of extracting secondary electrons from the cathode contacts 10 constituting the bank. These secondary electrons are either, when the voltage of the cathode contacts 10 is greater than the voltage 21 of the suppressor 21, pushed back by said suppressor 21 and reabsorbed by the contacts 10, so that these contacts are negatively charged and their potential decreases, or, when the voltage is less than the voltage $V_{21}$, are absorbed by the suppressor, which then acts as a collector electrode. The potential of the cathode combs 5 is, therefore, maintained, due to the action of the suppressor 21, at low positive values close to the voltage $V_{21}$ of this suppressor (the potential of the cathode contacts, as a matter of fact, cannot become negative since it would push the beam back and cancel out the current transmitted).

At a given moment there is thus established at the place of intersection of the anode strip 4 and of the cathode comb 5 whose contacts are excited — excited contacts defined by the instantaneous position occupied by the two moving beams coming from the electron guns — a difference in potential (and therefore an electric field) which arises up to a value sufficient to bring about an extraction of electrons by field emission from the point 7 located at this point of intersection. The electrons emitted by field effect from the point 7 are then accelerated by this potential difference, strike the anode strip 4, pass through it while slowing down, and penetrate into the portion of the layer of phosphor 3 located opposite this point of intersection, thus assuring the exciting of this phosphor, which excitation gives rise to an emission of light.

We may recall that this difference in potential which is establshed at the intersection of the excited contacts may be obtained precisely, on the one hand by the special zigzag configuration of the anode contacts 13, which makes possible, by favoring a bombardment under partically grazing incidence, a large increase in the secondary electron yield and, therefore, the obtaining of a strongly positive potential and, on the other hand, by the presence around the cathode contacts 10 of the suppressor 21, which makes it possible to maintain the contacts excited at a slightly positive potential.

When they are no longer excited, these cathode or anode contacts see their potential change, as a result of a residual electron emission of very short duration, from the values indicated above to "floating" values, which evolve by themselves until there is a blocking of the emission (that is to say, until the resultant potential difference becomes less than the threshold of emission of the low voltage points). We may also recall that the presence of the grid 8, which has been brought to the strongly negative potential $V_8$ has the role of modifying the natural characteristics of the low voltage emitters 7, making it possible to adjust these characteristics to the values required for the exciting of the phosphor.

The explanations which have just been given make it possible clearly to understand why one can obtain illumination at any point of the luminescent screen, but still not to understand how one can regulate the luminous intensity thus obtained so as to obtain the restitution of said image on the screen as a function of electric signals representing a given image. Let use examine this problem in further detail.

From the explanations previously given, it can be seen than the luminous intensity (or brightness) which results from the excitation of the phosphor depends therefore both on the potential difference which serves to accelerate the electrons emitted by field effect and on the current carried by these electrons. Let $\Delta V$ be this potential difference and I this current. In order to vary, as desired, the luminous intensity of any point of the screen (in order, for instance, to produce a given display or to reproduce television pictures) it is therefore necessary, in principle to be able to vary this current I and/or this potential difference $\Delta V$. However, it is preferable, for the reasons which follow, to maintain the potential difference $\Delta V$ as constant as possible and to vary only the current I. As a matter of fact, since the anode strips have capacitances with respect to ground which cannot be lowered below a certain limit value (of the order of a few picofarads), the passage from one luminous intensity to another implied a certain lapse of time (in order to charge or discharge these capacitors), which period of time is longer the larger the variation of $\Delta V$. This period of time results, above a certain sweep frequency, in a loss of definition of the display (a phenomenon which can be noted for the sweep frequencies used in television). In order to eliminate this drawback, it is therefore advisable to eliminate to the maximum the differences which might be experienced by this value $\Delta V$.

However, it is not possible, in order to control this luminous intensity as desired, to act directly on the values I and/or $\Delta V$, which remain internal values of the system. The only parameters on which one can act directly are, as a matter of fact, the parameters external to the system, namely: intensity of the beams coming from the cathode gun 28 or the anode gun 24, or voltages of the suppressor 21 or of the collector 19 (voltages which make it possible to exert an overall action on the voltage of the cathode or anode contacts). It is therefore advisable to examine in further detail the process by which the phosphor is excited (that is to say, how the values I and $\Delta V$ are established) as a function of these external parameters, and to see how this process evolves (that is to say, how these values I and $\Delta V$ vary) as a function of the variations which are imposed on these outside parameters.

To simplify matters, let us assume that in the device described one decides to act solely on the intensity of the anode beam 25, the other external parameters being maintained constant. The luminous intensity obtained on the screen is therefore regulated solely by the modulation of the anode beam 25 (to obtain a television picture, for instance, one would thus apply the video signal to the anode gun).

Let us suppose, first of all, that the anode gun 24 delivers a flow of electrons 25 carrying a specified current $I_a$, and let $I_1$ be the current flowing in each of the cathode combs 5 which corresponds to the cathode contact 10 struck by the beam 29, $I_2$ the current flowing in that one of the anode strips 4 which corresponds to the anode contact 14 struck by the anode beam 25, and I the current carried by the electrons emitted by field effect by the point 7 located at the place of intersection of said anode strip and said cathode comb. Let $V_1$ be the cathode contact potential 10, and therefore the potential of the corresponding comb 5, with respect to the cathode of the cathode gun 28, $V_2$ the potential of the anode contact 13 and therefore of the corresponding strip 4, with respect to the cathode of the anode gun 24, and let us assume that the cathodes of the cathode gun 28 and anode gun 24 are at the same potential, for instance at ground potential. Under these conditions, the potential difference $\Delta V$ which exists between the anode strip 4 and the cathode comb 5 is equal to $\Delta V = V_1 - V_2$.

Figure 8:
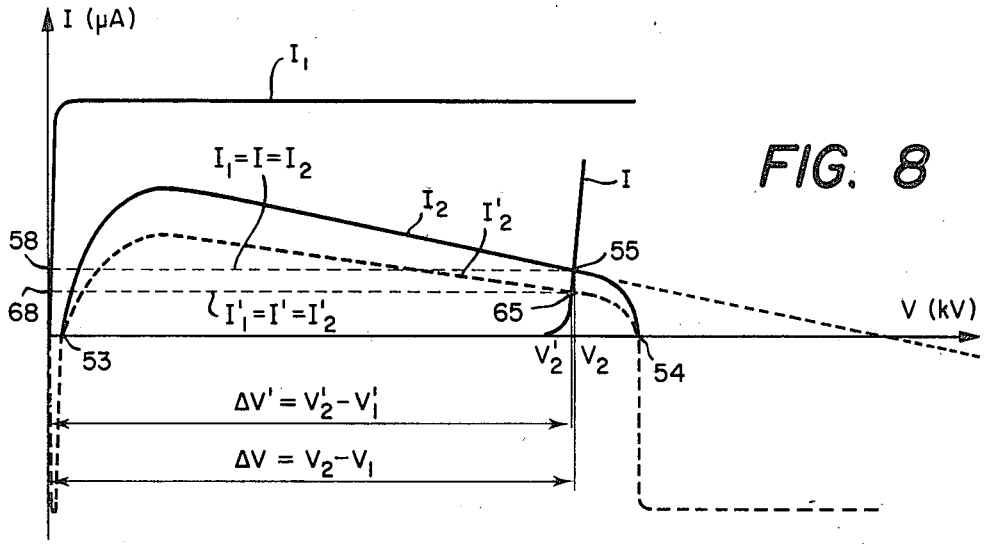
FIG. 8 shows curves concerning the physical phenomenon employed in the first embodiment.

The anode current $I_2$ which results from the balance between the secondary emission current produced by the anode contact 13 under the effect of the impact of the electrons of the anode beam 25 and the anode beam current $I_a$ which these electrons carry, depends on the potential $V_2$ of the contact 13, in accordance with a law represented by the curve $I_2$ of FIG. 8. This curve is drawn in an I-V diagram in which the zero of $I_2$ is placed on the V axis. Under these conditions, points 53 and 54, which correspond in this curve to the value $\sigma = 1$ of the yield of secondary electrons, are located on the abscissa axis. The portion of this curve which is located between the points 53 and 54, and therefore above this axis, corresponds to $\sigma > 1$; as this is the useful portion, it is drawn in solid line; the portions which are used to the left of the point 53 and to the right of the point 54, and therefore below the abscissa axis, correspond to $\sigma < 1$; they are drawn in dashed line (the strongly descending course near the point 54 of the positive portion of this curve $I_2$ results from the presence of the collector electrode 19; the dotted line extension of the linear portion of this curve $I_2$ illustrates the shape which this curve would have in the absence of the electrode 19).

The leakage currents being assumed negligible, the current $I_2$, in order to satisfy the law of the conservation of current, must have the same value as the current I resulting from the emission by field effect of the cathode comb 5. This current I varies as a function of the potential difference $(V_2 - V_1)$ in accordance with the law which, as explained above, is represented by the equivalent characteristic I of FIG. 8 (characteristic translated from the low voltage characteristic of the point by an amount $-kV_8$). The practically vertical branch of this curve I intersects the curve $I_2$ at a point 55 which corresponds to equality of the currents $I_2$ and I, and which constitutes the working point. The abscissa of this working point defines the potential $V_2$ (measured with respect to the cathode of the anode gun 24) which the anode strip 4 and its contact 13 assume at equilibrium; the ordinate of this point defines the current I which, at equilibrium, is supplied by the field emission of the cathode comb 5, and therefore the current $I_1$ which passes through this comb and its contact 10. Now this current $I_1$, which results from the balance between the current of the cathode beam 29 carried by the electrons emitted by the cathode gun 28, and the seconary emission current produced by the cathode contact 10 under the effect of the impact of the electrons of this cathode beam 29 depends on the potential $V_1$ of the contact 10 in accordance with a law represented by the curve $I_1$ of FIG. 8, which comprises a first practically vertical branch followed by a second practically horizontal branch.

The ordinate $I_1 = I = I_2$ corresponds, on this ascending branch, to a point 58, the abscissa of which defines the potential $V_1$ which the cathode comb 5 and its contact 10 must have at equilibrium wth respect to the cathode of the cathode gun 28.

It is therefore seen that, for a given anode beam intensity $I_1$, there is established in the system an equilibrium corresponding to a current $I$ and to a potential difference $\Delta V$ which are clearly specified and which give rise to an illumination of the phosphor with a well-defined luminous intensity.

Let us now assume that the intensity of this anode beam is varied, it assuming for instance a value $I'_a$, less than $I_a$. The curves I and $I_1$ drawn in the diagram of FIG. 8 remain unchanged.

The curve $I_2$ on the other handis replaced by a curve $I'_2$, of flatter shape. This curve $I'_2$ intersects the curve I at a point 65 which constitutes the new working point. The abscissa of this point 65 defines the new potential $V'_2$ which the anode strip 4 and its contact 13 assume, while its ordinate defines the new current I' which, at equilibrium, is supplied by the field emission. This ordinate corresponds on the curve I' to a point 68 whose abscissa defines the new potential V' which the cathode comb 5 and its contact 10 have at equilibrium. Under these conditions, the new potential difference $\Delta V'$ which exists between the anode strip 4 and the cathode comb 5 is equal to $\Delta V' = V'_1 - V'_2$.

Thus the fact that the intensity of the anode beam is reduced from a given value $I_a$ to another $I'_a$ which is less than $I_a$ brings about, jointly, a decrease in the emission current from the value I to the value I' and a decrease in the accelerating potential difference from the value $\Delta V = V_2 - V_1$ to the value $\Delta V' = V'_2 - V'_1$, which in their turn result in a decrease in the luminous intensity produced on the screen. One thus observes an automatic adaptation of the luminance of the phosphor to the signal controlling the intensity of the anode beam, by means of a simultaneous adjustment of the values I and $\Delta V$.

One can however note in FIG. 8 that the presence of a characteristic I ($\Delta V$) of strong slope makes it possible to limit to the maximum the differences which might be experienced by the value $\Delta V$ and therefore to eliminate the risks of loss of definition for the display which might occur as a result of the capacitative effects mentioned above. On the other hand, a strong dispersion of this characteristic I ($\Delta V$) would have had the harmful consequence of resulting in a flickering of the display due to these same capacitative effects. It will therefore be understood why it is particularly desirable to have a characteristic I($\Delta V$) of steep slope and reduced dispersion.

We may recall that this high voltage characteristic with steep slope and reduced dispersion is obtained by the combined used of low voltage emitter points 7 and a grid 8 brought to a strongly negative potential.

The preence of a grid brought to a negative potential, furthermore, has the additional advantage, by attracting towards it a large part of the ions which are formed in the space between emitters and anode strips, of considerably reducing the ionic errosion of these emitters.

Likewise, the zigzag configuration of the bank of anodic contents 14, in addition to the advantages cited above, has other additional advantages. The angle of incidence of about 80° of the anode beam 25 on these contacts (angle of incidence with respect to the normal to the contacts) obtained by a suitable selection of the opening angle of the "zig-zags" and of the position of the anode gun 24 with respect to the bank 14, repesents an optimum compromise between the desire of obtaining the highest possible electron yield $\sigma$ possible and the difficulty of controlling the angle in the vicinity of grazing incidence (critical effect of the variation of the angle). This angle of incidence is, furthermore, insensitive to the variation in position of the contacts 13 from one end to the other of the bank 14, due to the "zig-zag" geometry of these contacts 13. This zigzag configuration finally makes it possible, upon the sweeping of the bank 14 by the primary beam 15, to minimize the edge effects of the contacts (bombardment of the sides of the contacts) which could occur when the beam 25 is in intermediate position between two contacts.

In the device described, the zigzag bands 13 are made of stainless steel. In places of this stainless steel one could use other materials whose secondary emission yield is also not substantially affected by pollution, such as iron, chromium, or nickel. One could also use other materials which are more sensitive to pollution, which could be previously subjected to artificial aging.

In the device which has just been described, the electron guns ar pointed perpendicularly to their respective contact banks. This particular arrangement has the great advantage of giving a linear sweep (the tangent of the angle of deflection being proportional to the defection voltage in electrostatic deflection). As a variant, one could point the guns towards the middle of their respective banks, so as to reduce by half the maximum angle of deflection of their beams; it is then necessary to assure a nonlinear sweeping of the contact banks.

It has been explained above that one could obtain the restitution of a picture on the luminescent screen by merely modulating the anode beam 25 by application to the anode gun 24 of the "video" signal representing this image. This manner of procedure is obviously not the only one possible and one can also, of course, proceed in the opposite fashion, maintaining the intensity of the anode beam 25 constant and modulating only the cathode beam 29 by application of the "video" signal to the cathode gun 28.

We may furthermore make it clear that the expression "signals representing the image is understood here to designate only the "video" signals bearing information relative to the intensities of the various component points of the image. It is obvious, however, that in order to obtain the reproduction of an image one must take into account, in addition to these signals, also the other conventional signals in the art of television, such as the sweep signals, synchronization signals, etc.

Figure 9:
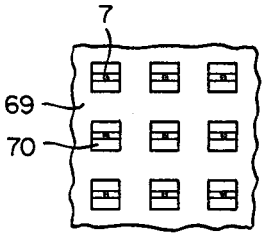
FIG. 9 is a partial view, similar to that of FIG. 5, illustrating a first variant.

The shape of grids shown in the embodiment described is not the only one possible. Instead of a grid formed of a network of interlaced wires forming meshes, one can, as a matter of fact, use other types of grids, formed, for instance, of simple parallel wires or else having the shape of a perforated mask. This last type of grid is shown in part in FIG. 9 where one can note a portion of plate 69 pierced by a regular system of rectagular holes 70 to the vicinity of the center of which the emitters 7 point. This perforated mask can be obtained mechanically or else, for instance, by photochemical attack.

Figure 10:
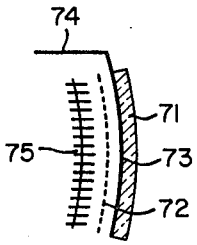
FIG. 10 is a partial view in section, similar to that of FIG. 3, illustrating a second variant.

In order to solve the problem of the deformations which might be caused by the electrostatic attraction (primarily between anode plate and grid), one can furthermore use slightly curved anode plates and grids. It is this variant which is shown in FIG. 10, in which one can see an anode plate 71 and a grid 72, both of which are slightly curved, the anode plate furthermore bearing a system of anode strips 73 connected to the contacts 74. In this FIG. 10, one can also note a system of cathode combs 75, slightly staggered with respect to each other so as to fit the curvature of the plate 71 and of the grid 72. By way of example, the curvature may correspond to a camber of the order of a few millimeters for a side of several hundreds of millimeters.

Figure 11:
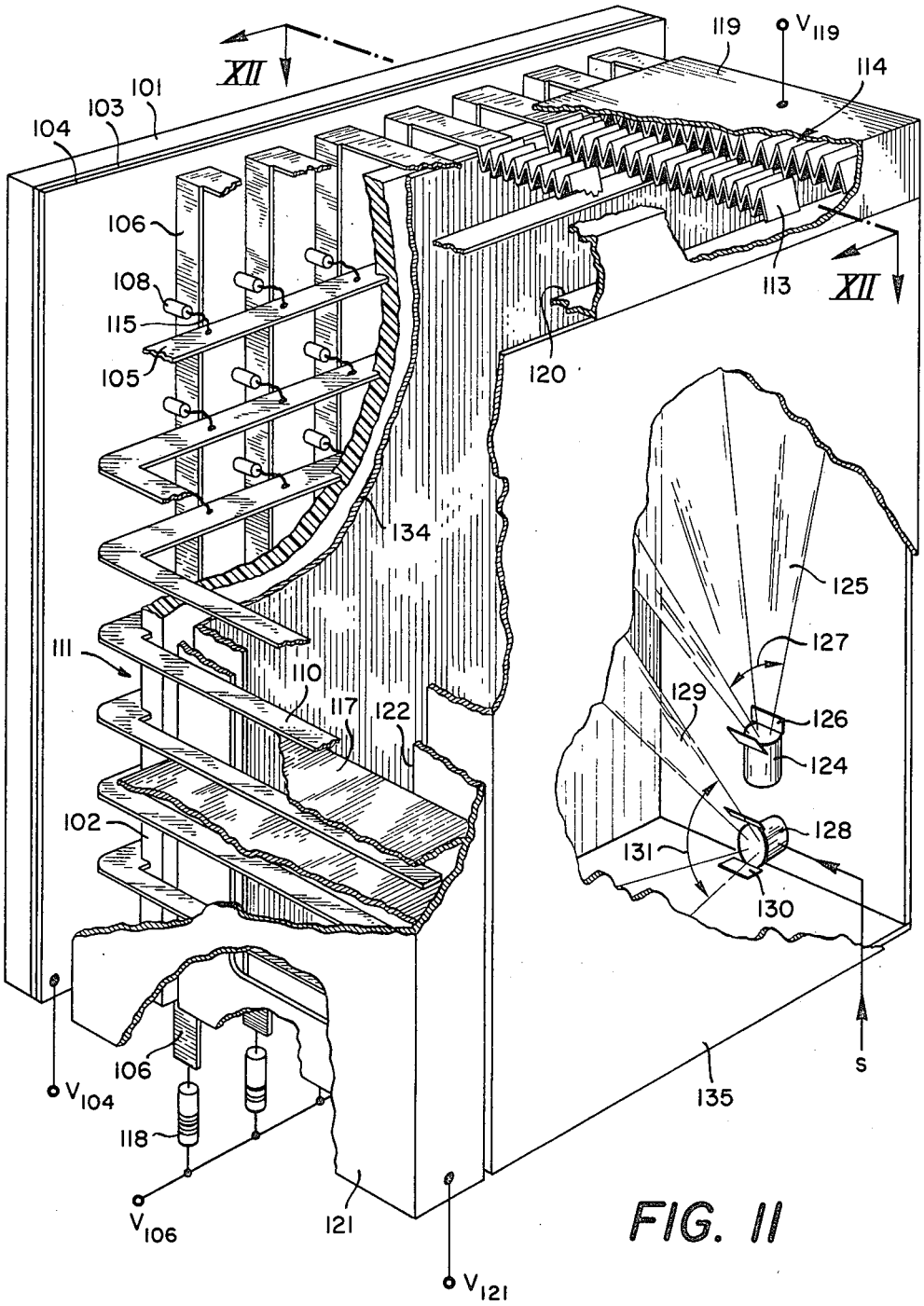
FIG. 11 is a perspective view, partially cut away, of the inner part of a second embodiment.
Figure 12:
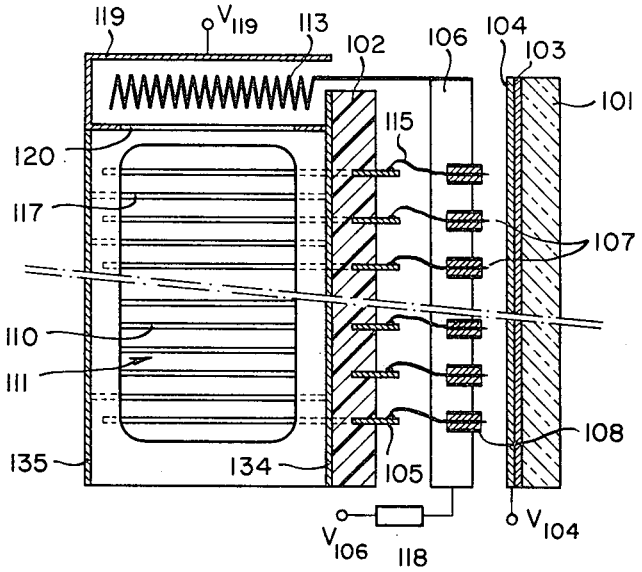
FIG. 12 is a sectional view along the line XII—XII of FIG. 11.
Figure 13:
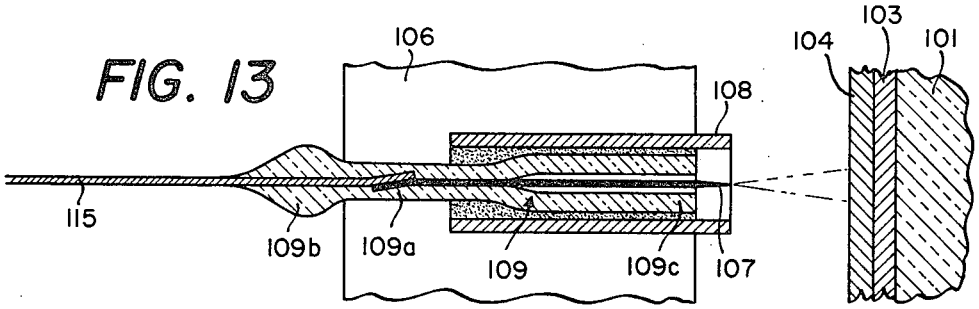
FIG. 13 is a detail view on a larger scale of FIG. 11.

The second embodiment, shown in FIGS. 11 to 13, constitutes, so to speak, an inversion of the first embodiment of FIGS. 2 to 7, in the sense tha the system of anode strips 4 is in this case replaced by a single anode layer which is common to all the emitters; while, the single grid 8 which is common to all the emitters is in this case replaced by a system of intermediate electrodes which are excited sequentially, the modulation (video signal) being futhermore applied to the cathode gun, instead of being applied to the anode gun as in the first embodiment.

This second embodiment comprises a first transparent support plate 101, called the anode plate, arranged opposite a second support plate 102, called the cathode plate. The face of the anode plate 101 opposite the cathode plate 102 is covered with a layer of luminescent material 103 which, in its turn, is covered with a very thin conductive layer 104, called the anode layer. Opposite the anode layer 104 and insulated from it there is arranged a first series of rigid conductive bands 106, called control bands which are electrically insulated from each other and arranged parallel to each other (in the vertical direction in the case of the example shown in FIG. 11) so that their flat face is perpendicular to the anode plate 101. In the face of the cathode plate 102 located opposite the anode plate 101 there is embedded a second set of conductive bands 105, called cathode conductors, which are electrically insulated from each other as well as from the control bands 106 and arranged parallel to each other in a direction perpendicular to the control bands (and therefore in the horizontal direction in the case of the example of FIG. 11).

On the flat face of each of the control bands 106 there are fastened a plurality of metallic, tubular, microconduits 108 (FIG. 12 and 13) arranged at regular invervals apart so that there is one microconduit 108 opposite each of the cathode bands 105, each of the microconduits 108 being furthermore arranged in such a manner that its axis is perpendicular to the anode plate 101. Within each of the microconduits 108 (FIG. 13) there is threaded an emitting point 107 pointing in the direction of the anode layer 104, arranged axially with respect to the microconduit 108 so that its pointed end is located substantially in the same plane as the end of the microconduit and insulated electrically from said microconduit by an insulating sheathing 109. Each of the emitting points 107 is connected electrically at its other end to the cathode band 105 located at its level by means of a conductive wire 115. The points 107 are, as in the first embodiment, low voltage points, that is to say points capable of emitting electrons for low extraction potential values (less than 1 kv).

By way of example, the emitting points 107 may be formed of carbon wires having a diameter of about 10 $\mu$ and a pointed end of a radius of curvature of the order of 1000 Angstroms. (These ends can, for instance, have been pointed by flame). Such points may typically emit a current of 0.1 microampere when a voltage drop of 200 volts prevails in the immediate vicinity of their end (or, respectively, a current of 10 microamperes when this voltage drop is 300 volts).

These points can be mounted within microconduits 108 having an inside diameter of about 0.3 mm and an outside diameter of about 0.4 mm, their pointed end being furthermore located about 1 mm from the anode layer 104 (which may be of aluminum). Such a configuration gives a coefficient $k$ (see further above) of about 10. The insulating sheathing 109 may be of glass and the connecting wire 115 may be a platinum wire of a diameter of about 20 $\mu$m.

By way of example, the mounting of the points 107 in the microconduits 108 can be effected as follows: a glass microtube 109 is used having an inside diameter of about 0.06 mm and an outside diameter of about 0.30 mm, and a platinum wire is threaded through one of its ends and a pointed carbon wire through its other end, leaving the pointed end of the said carbon wire protruding towards the outside; thereupon flame sealing is effected in the vicinity of the end of the glass tube opposite the carbon point so as to obtain a good electrical contact between platinum wire and carbon wire, the said flame sealing resulting in the formation, at this end, of a narrowing 109*a* followed by a bulb 109*b* (FIG. 13). The glass tube 109 is then introduced, by its end 109*c* opposite the bulb 109*b*, into the microconduit 108 until the pointed end of the carbon wire 107 is flush with the end of the microconduit 108, and the glass tube 109 is then sealed in the microconduit 108, for instance by cementing.

In a manner similar to that described in the first embodiment, the cathode conductors 105 are connected to blades 110 which project beyond the rear face of the cathode plate 102 (the flat face of these blades 110 being nevertheless arranged horizontally instead of being arranged vertically as in FIG. 2), while the control bands 106 are connected to "zig-zag" bands 113 which also project beyond the rear face of the cathode plate 102. The assembly of blades 110 constitutes a bank 111 of cathode contacts aligned along the vertical edge of the cathode plate 102, while the assembly of zig-zag bands 113 constitutes a bank 114 of "control" contacts aligned along the horizontal edge of said plate 102. The bank of "control" contacts 114 is surrounded by a collector electrode 119, provided with a window 120 which practically completely discloses the set of "zig-zag" bands 113, while the bank of cathode contacts 111 is surrounded by a so-called suppressor electrode 121 provided with a window 112 which discloses practically the entire set of contact blades 110. This suppressor electrode 121 is furthermore provided with a plurality of conductive partitions 117 which separate the contact blades 110 from each other, without however being in electrical contact with them.

The lower ends of the control bands 106 (that is to say the ends opposite those connected to the zigzag bands 113) are connected, via resistors 118, to a first external voltage source $V_{106}$. The collector electrode 119 is connected to a second external voltage source $V_{119}$ which is higher than the potential to which the "zig-zag" bands 113 can be brought. The suppressor 121 is connected to a third external voltage surce $V_{121}$ which is higher than that of the voltage source $V_{106}$. Finally the anode layer 104 is connected to a fourth external voltage source $V_{104}$ which is much greater than the potential to which the cathode contacts 110 can be brought.

The resistors 118 (FIG. 11) have values of the order of 10 M$\Omega$. Instead of using a plurality of "solid" resistors (as shown in the drawing) one can, furthermore, use so-called "integrated" resistors, obtained for instance by evaporating resistive strips of $SnO_2$ on an insulating support.

In a manner similar to that of the first embodiment, there is also present between the shieldings 134 and 135, in electrical contact with the collector electrode 119 (but insulated from the suppressor 121), a first gun 124, called the "control" gun and pointing in the direction of the control bank 114, and a second gun 128, called the cathode gun, pointing in the direction of the cathode bank 111 respectively. The control gun 124 is equipped with focusing means which make it possible to obtain an electron beam 125, as well as sweep means (deflector plates 126) which cause said beam 125 to sweep the control bank 114, while the cathode gun 128 is equipped with focusing means which make it possible to obtain an electron beam 129 as well as sweep means (deflector plates 130) forcing said beam 129 to sweep the cathode bank 111.

The assembly thus described is contained in an air-free enclosure similar to that previously described.

The operation of the device which has just been described is as follows: let us assume that the intensity of the electron beam 125 coming from the control gun 124 is maintained constant and that only the intensity $I_c$ of the electron beam 129 coming from the cathode gun 128 is modulated by applying to it, for instance, a "video" signal representing an image the restitution of which is desired on the luminescent screen (which application is indicated schematically in the drawing by the arrow s). Furthermore let $V_g$ be the potential of the control bands 106 with reference to the cathode of the control gun 124 (and therefore the potential of the contacts 113 which are connected to them as well as of the microconduits 108 which are fastened there), and let $V_1$ be the potential of the cathode bands 105 with respect to the cathode of the cathode gun 128 (and therefore the potential of the contacts 110 which are attached to them as well as emitters 107 which are electrically connected to them), the cathodes of the guns 124 and 128 being moreover grounded, and let $I_1$ be the current flowing in the cathode bands 105 and I the current carried by the electrons emitted by field effect by the emitters 107.

The control bands 106 are normally brought, in the absence of any sweeping of the contacts 113 by the beam 125, to a potential $V_g$ which is equal to the potential $V_{106}$. The sweeping of the bank of control contacts 114 by the beam 125 of constant intensity has the effect of sequentially bringing the control bands 106, corresponding to their contacts 113 struck by this beam, to a potential $V'_g$ which is greater than the initial potential $V_{106}$. Let $\Delta V_g = V'_g - V_{106}$. By way of example, the intensity of the beam 125 is so determined that this potential difference $\Delta V_g$ is equal to + 600 volts.

There thus prevails in the immediate vicinity of any emitter 107, when this emitter is borne by an unexcited control band 106, a potential equal to the value $(V_{104} + k\ V_{106})/(1 + k)$ or, when this emitter is borne by an excited control band 106 a potential equal to the value $(V_{104} + k\ V_{106} + k\ \Delta V_g)/(1 + k)$. By way of example, let the voltages of the different external voltage sources taken be equal respectively to +3500 volts for the source $V_{106}$, +5000 volts for the source $V_{119}$, +4000 volts for the source $V_{121}$ and +10,000 volts for the surce $V_{104}$. In view of the fact that the coefficient $k$ is close to 10 for the configuration adopted, there thus prevails a voltage of about 4100 volts in the immediate vicinity of an emitter 107 borne by an unexcited microconduit 108 and a voltage of about 4600 volts in the immediate vicinity of an emitter 107 borne by an unexcited microconduit 108 respectively.

The cathode bands 105 (and, therefore, the emitters 107 connected to these bands) are normally brought, in the absence of any sweeping of the cathode contacts 110 by the beam 129, to a "floating" potential whose value is such as to prevent any field effect emission (the bands rapidly reach such a floating potential as a result of a residual emission of very short duration).

The sweeping of the bank of cathode contacts 111 by the beam 129 of variable intensity $I_c$ has the effect (as a result of the extraction of these cathode contacts and of the suppressor of secondary electrons which are, depending on the voltage value of these contacts with respect to the voltage of the suppressor 121, either pushed away or absorbed by this suppressor) of sequentially lowering the potential of the cathode bands 105 from the "floating" value corresponding to the blocking of the emission to a value $V_1$ which depends on the intensity $I_c$ of the incident beam 129. This value $V_1$ is lower, the higher the intensity $I_c$ of the beam 129, and it approaches the voltage $V_{121}$ of the suppressor 121 when the intensity $I_c$ approaches its maximum value. With the voltage values mentioned above, it is found that this voltage $V_1$ varies from about 4500 V to 4000 V depending on the intensity $I_c$ of the incident beam. The partitions 117 of the suppressor 121 have the purpose of preventing any disturbing interaction (from the point of view of secondary electron flux) between adjacent contacts 110.

At a given moment, there is thus established simultaneously at the intersection of the excited bands and in the immediate vicinity of the excited emitter 107, respectively, a slight potential difference (equal to$(V_{104} + k\ V_{106} + k\ \Delta V_g)/(1 + k) - V_1)$ ) which is sufficient to cause the emission by this emitter 107 of electrons carrying a current I which depends on $V_1$ and therefore on the intensity $I_c$ of the incident beam 129, and in the vicinity of the portion of the anode layer 104 a substantially greater potential (equal to $V_{104} - V_1$) sufficient to impart the electrons emitted the energy required to cause the excitation of the portion of phosphor in contact with said anode portion and therefore the illumination of this phosphor. The luminous intensity of this portion depends on this potential difference $(V_{104} - V_1)$ as well as on the intensity I of the emission current, and therefore on the intensity $I_c$ of the modulated incident beam 129.

Figure 14:
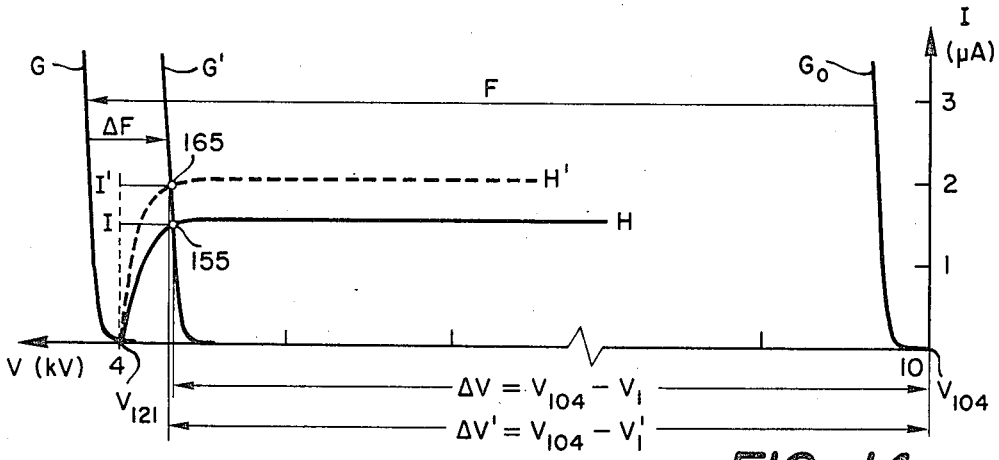
FIG. 14 shows curves relating to the physical phenomenon employed in the second embodiment.

Let us now examine how the aforementioned variations may be shown graphically by means of the I-V diagram of FIG. 14. The real characteristic of the emitters 107, that is to say the characteristic which would be seen from the outside of the system in the absence of microconduits 108 brought to the potential $V_g$ (these microconduits 108 playing a role similar to that of the intermediate electrode "g" referred to above), has the shape of the curve $G_o$ appearing in this diagram (curve drawn with respect to the fixed anode potential $V_{104}$ taken as reference).

The interposing of the microconduits 108 brought to the potential $V_g$ (that is to say of the unexcited microconduits) has the effect of resulting in a first translation (indicated schematically by the arrow F) of the curve $G_o$ which is transformed into the apparent characteristic G (located in the drawing to the left of the vertical line intersecting the abscissa axis at $V_{121}$). The excitation of the microconduits 108 (that is to say the increase in the voltage of thse microconduits by $\Delta V_g$) has the effect of resulting in a second translation (indicated diagrammatically by the arrow ΔF) of the characteristic, which is transformed into the curve G' (located to the right of the aforementioned vertical line). Moreover, the cathode current $I_1$ which results from the balance between the current $I_c$ of the cathode beam 129 and the secondary emission current produced by the cathode contact 110 under the effect of the impact of the beam 129 depends, for a given current intensity $I_c$, on the potential $V_1$ of said contact 110 in accordance with a law represented by the curve H of FIG. 14. (This curve, which intersects the abscissa axis at $V_{121}$, comprises a first ascending portion and a second substantially horizontal portion, asymptotic to a value porportional to the intensity $I_c$ of the cathode beam). The curve H intersects the curve G' at a point 155 which constitutes the working point. The abscissa of this point defines the potential $V_1$ assumed at equilibrium by the emitter 107 located at the intersection of the excited bands, and the ordinate of this point defines the current I carried at equilibrium by the electrons emitted by this emitter The difference $\Delta V = V_{104} - V_1$ gives the potential difference which is established at equilibrium between the anode layer 104 and this emitter 107. It is thus seen that for a given cathode beam intensity $I_c$, there is established in the system an equilibrium corresponding to a current I and a potential difference $\Delta V$, both of which are well determined and which give rise to an illumination of the phosphor of a well-defined luminous intensity.

It has been said that the shape of the curve H depended on the intensity $I_c$ of the cathode beam. There is, therefore, an entire family of curves H corresponding to the range of values capable of being assumed by $I_c$, which family, by intersection with the curve G', defines a plurality of working points. Let us assume, for instance, that the intensity of the cathode beam assumes a value $T_c$ which is greater than $I_c$. To this new value $I'_c$ there corresponds, in the diagram of FIG. 14, the curve H' which intersects the curve G' at a new working point 165. This point 165 defines the new potential $V'_1$ assumed at equilibrium by the emitter 107 and therefore the new potential difference $\Delta V' = V_{104} - V'_1$ which is established between the anode layer 104 and the emitter 107, as well as the new current I' carried by the electrons emitted by said emitter. It is therefore seen that to this higher cathode beam intensity $I'_c$ there correspond a higher intensity I' and a higher potential difference $\Delta V'$, which results in a more intense illumination on the screen.

The second embodiment described above has a certain number of advantages over the first embodiment shown in FIGS. 2 to 7. First of all, it permits a more precise positioning of the points with respect to the intermediate elements "g" (intermediate elements "g" constituted in the second embodiment by the different microconduits 108 and in the first embodiment by the single grid 8, respectively). An imprecise positioning would result, as a matter of fact, in a harmful dispersion in the translation of the characteristic of the emitters. It then makes possible an easier insulating of the system, in view of the fact that the voltage of the microconduits 108 remains close to that of the emitters. It furthermore permits a better "focusing" of the emission of the points (the microconduits 108 acting at the same time as electrostatic lenses) onto precise points of the screen, which, in the case of color reproduction, contributes to the purity of the colors obtained. In addition, it permits of a simplification in the design of the screen (presence of a single conductive layer instead of a plurality of conductive strips insulated from each other). The second embodiment finally results in better dynamic sensitivity to video signals (slope of characteristics maximum).

The device in accordance with the invention lends itself to all uses concerned in the image-conversion of electric signals and it advantageously replaces all the known cathode ray devices when it is a question of displaying in the clear (that is to say in visible manner) alphanumeric information which is coded in the form of analog signals or when it is a question of reproducing television pictures. In this last application, the line and frame sweep means are formed by the sweeping of the cathode and anode banks (first embodiment) or of the cathode and control banks (second embodiment) by electron beams; the luminance of the phosphor can be modulated by acting, for instance on the cathode or anode gun. By way of example of this application to television, the device may comprise a matrix of 500 cathode bands and 500 anode strips (or 500 control bands).

Such a device may furthermore easily be adapted to color television by using, for instance, arrangements similar to those already described in the aforementiond Swiss Pat. No. 556,605.

Thus, with respect to the first embodiment, and in the event that the modulation is applied on the anode side, the following arrangements can be provided: use of a luminescent layer formed of a series of triplets each of which is formed of three parallel strips of blue, red and green luminescence respectively; covering of each of these triplets by a triplet of conductive anode strips; presence of a triple "zig-zag" contact bank, with each of the contacts formed of three "zig-zag" bands of different length connected individually to the three strips of the triplets of strips; the use of three anode electron guns each sweeping one of the three series of bands of the triple bank; and interposition between the bank and the guns of stair-shaped masks adapted to prevent the beam of a gun assigned to a given series of banks from sweeping the banks of the other two series. By way of example, there may be used a matrix of 1500 anode strips and 500 cathode combs each provided with 1500 emitters.

Likewise, still for this first embodiment but in the event that the modulation is applied on the cathode side, the following arrangements can be provided: presence of a plurality of anode strips in contact with the screen; presence under each of these strps and over the entire length thereof of a series of triplets each of which is formed of three aligned "quasi-point" zones of blue, red, and green luminescence respectively, the triplets placed at the same level under the different strips being aligned with respect to each other; presence opposite these alignments of luminescent triplets of cathode comb triplets; presence of a triple cathode-contact bank with each of the contacts formed of three bands of different length connected individually to the three combs of the comb triplets; use of three cathode guns each sweeping one of the three series of bands of the triple bank; and interposition, below the bank, of step-shaped masks adapted to prevent any mask assigned to a given series of bands from sweeping the other two series of bands. By way of example, for this there can be used a matrix of 500 anode strips and 1500 cathode combs each provided with 500 emitters.

Finally, for the second embodiment, one can provide an arrangement which is practically similar to that which has just been described (first embodiment with-modulation applied on the cathode side) except that the anode strips are in this case eliminated and replaced by control bands which are insulated from the anode layer in contact with the series of triplets each formed of three punctiform zones. By way of example, one may use a matrix of 500 controls bands and 1500 cathode combs each provided with 500 emitters.

We claim:

1. Video cathode tube intended for the restitution in visible form of electric signals representing an image, comprising an air-free enclosure defined by a wall a portion of which constitutes a transparent window, said enclosure containing:

a. a layer of at least one luminescent substance carried by a transparent plate, this layer having a size substantially equal to that of said window and being visible through it;

b. a matrix of field effect emitters of low emission threshold distributed in rows and columns, oriented in such a manner as to emit towards the said luminescent layer;

c. a first system of conductive paths insulated from each other and arranged along the rows of emitters, each of the emitters of any row being connected electrically to the corresponding path of the said first system;

d. a second system of conductive paths insulated from each other and from the paths of the said first system, disposed in contact with said luminescent layer and extending in front of the columns of emitters;

e. a first energizing device comprising a first bank of contacts connected individually to the paths of said first system at one end of them, and a first means for sequentially bringing the contacts of said first bank to a first potential;

f. a second energizing device comprising a second bank of contacts connected individually to the paths of said second system, at one end of them, and a second means for sequentially bringing the contacts of said second bank to a second potential;

g. and a control electrode in the form of a grid connected to a source of voltage interposed between said matrix of emitters and said second system of conductive paths and having substantially the same length as them, the selection of the voltage of said source and of said second potential with respect to the said first potential being such that at the intersection of the paths brought respectively to said first and second potentials there prevails, simultaneously, in the immediate vicinity of the end of the emitter located at said intersection a low voltage drop which is sufficient to cause the emission by field effect of electrons from said emitter and in the vicinity of the portion of luminescent layer located at said intersection a high potential drop capable of imparting to the electrons emitted sufficient energy to excite said luminescent layer portion, the said first or second energizing devices being modulated by the said signals in such a manner that said luminescent layer portion is illuminated as a function of the said signals, the group of luminous points thus obtained sequentially constituting the said image.

2. Tube according to claim 1 wherein the threshold of emission of the said field effect emitters is less than 1 kilovolt.

3. Tube according to claim 1, in which each of said contacts of said second bank is formed of a band made at least in part, of a material having secondary electron emission properties, and said second means comprises an electron gun capable of emitting an electron beam capable of sweeping each of said bands, wherein said bands are arranged with respect to said electron beams in such a manner that said beam strikes said bands with an oblique incidence such that the secondary electron emission yield of these bands is greater than 1.

4. Tube according to claim 1, in which each of said contacts of said first bank is formed of a band made of secondary electron emission material and said first means comprises an electron gun capable of emitting an electron beam capable of sequentially sweeping each of said contacts, wherein in the vicinity of said first bank, there is arranged an electrode connected to an external voltage source intended to maintain the said first potential of the said contacts struck by the beam of the said first gun at a value greater than and/or equal to the value of the voltage of said voltage source.

5. Video cathode tube intended for the restitution in visible form of electric signals representing an image, comprising an air-free enclosure defined by a wall of portion of which constitutes a transparent window, said enclosure containing:

a. a layer of at least one luminescent substance carried by a transparent plate, said layer having a size substantially equal to that of said window and being visible through it;

b. a matrix of field effect emitters of low emission threshold distributed in rows and columns, oriented in such a manner as to emit towards the said luminescent layer;

c. a first system of conductive paths insulated from each other and disposed along the rows of emitters, each of the emitters of any row being connected electrically to the corresponding path of the said first system;

d. a second system of conductive paths insulated from each other and from the paths of said first system and extending along the columns of emitters, while being arranged in the immediate vicinity of said emitters;

e. a first energizing device comprising a first bank of contacts connected individually to the paths of said first system, at one end of them, and a first means for sequentially bringing the contacts of said first bank to a first potential;

f. a second energizng device comprising a second bank of contacts connected individually to the paths of said second system, at one end of them, and a second means for sequentially bringing the contacts of said second bank to a second potential;

g. and an electrode connected to a voltage source, formed of a thin conductive layer arranged in contact with the said luminescent layer and having substantially the same length as it, the selection of the voltage of said source and of said second potential with respect to the first potential being such that at the intersection of thepaths brought respectively to said first and second potentials there prevails, simultaneously, in the immediate vicinity of the end of the emitter located at said intersection a low voltage drop which is sufficient to cause the emission by field effect of electrons from said emitter and in the vicinity of the portion of luminescent layer located at said intersection a high potential drop capable of imparting to the electrons emitted sufficient energy to excite said luminescent layer portion, the said first energizing device being modulated by the said signals in such a manner that said luminescent layer portion is illuminated as a function of the said signals, the group of luminous points thus obtained sequentially constituting the said image.

6. Tube according to claim 5, in which each of said contacts of said second bank is formed of a band made, at least in part, of a material having secondary electron emission properties, and said second means comprises an electron gun capable of emitting an electron beam, capable of sweeping each of said bands, wherein said bands are arranged with respect to said electron beam in such a manner that said beam strikes said bands with an oblique incidence such that the secondary electron emission yield of these bands is greater than 1.

7. Tube according to claim 6, wherein said bands are arranged with respect to said electron beam in such a manner that said beam strikes said bands under an incidence the angle of which with respect to the normal to the struck surfaces is between 60 and 90°.

8. Tube according to claim 7, wherein the said angle of incidence is preferably between 80 and 85°.

9. Tube according to claim 7, wherein each of said bands is folded on itself in zig-zag shape.

10. Tube according to claim 9, wherein the angle of opening of the zig-zags is preferably between 10 and 20°.

11. Tube according to claim 5, in which each of said contacts of said first bank is formed of a band made of secondary electron emission material and said first means comprises an electron gun capable of emitting an electron beam capable of sequentially sweeping each of said contacts, wherein in the vicinity of said first bank, there is arranged an electrode connected to an external voltage source inteded to maintain the said first potential of the said contacts struck by the beam of the said first gun at a value greater than and/or equal to the value of the voltage of said voltage source.

12. Tube according to claim 5, wherein each of the paths of the said second system comprises a plurality of conductive elements arranged in such a manner with respect to the said emitters that each of the emitters of any column is surrounded by one of said conductive elements 13. Tube according to claim 14, wherein the said emitters are formed of filiform elements with a pointed end and the said conductive elements are formed of metallic tubular elements the said filiform elements being inserted within said tubular elements in such a manner that their pointed end is flush with one of the ends of said tubular elements and said filiform elements being centered on the axis of the tubular elements and electrically insulated from the latter by means of an insulating sheathing.

14. Tube according to claim 5, wherein the threshold of emission of the said field effect emitters is less than 1 kilovolt.

* * * * *